US008511777B2

(12) United States Patent
Tanoue et al.

(10) Patent No.: US 8,511,777 B2
(45) **Date of Patent: *Aug. 20, 2013**

(54) FLUID EJECTING APPARATUS AND FLUID EJECTING METHOD

(75) Inventors: Takeshi Tanoue, Matsumoto (JP); Bunji Ishimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 277 days.

This patent is subject to a terminal disclaimer.

(21) Appl. No.: 12/854,829

(22) Filed: Aug. 11, 2010

(65) Prior Publication Data

US 2011/0037800 A1 Feb. 17, 2011

(30) Foreign Application Priority Data

Aug. 13, 2009 (JP) ..... 2009-187832
Aug. 18, 2009 (JP) ..... 2009-188944
Dec. 4, 2009 (JP) ..... 2009-276714

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS 6,511,144 B2 1/2003 Otsuki
6,719,403 B2 4/2004 Kanda et al.
7,267,425 B2 9/2007 Kawase et al.
7,407,277 B2 8/2008 Yoneyama
7,562,957 B2 7/2009 Mills et al.
8,201,908 B2 6/2012 Tanoue et al.
2004/0233249 A1* 11/2004 Vanhooydonck ..... 347/41
2009/0160895 A1* 6/2009 Matsuzawa ..... 347/12
2011/0025744 A1* 2/2011 Ishimoto et al. ..... 347/14

FOREIGN PATENT DOCUMENTS

JP 2002-038063 A 2/2002
JP 2002-166578 A 6/2002
JP 2003-326779 A 11/2003
JP 2007-223139 A 9/2007
JP 2008-221645 A 9/2008

* cited by examiner

*Primary Examiner* — Laura Martin

(74) *Attorney, Agent, or Firm* — Kilpatrick Townsend & Stockton LLP

(57) ABSTRACT

A first and a second nozzle array eject a first and a second fluid, respectively. A control section controls the nozzle arrays while relatively shifting a relative position between the nozzle arrays and a medium. When printing normally, the relative position between the nozzle arrays and the medium is shifted towards one side by a transporting distance. When forming a second image using the second fluid over a first image formed using the first fluid, the second image's nozzles are located towards the one side relative to the first image's nozzles. When printing near an edge of the medium, a non-ejection one of the nozzles is located towards the one side of the first image's nozzles, and is located towards the other side of the second image's nozzles. A length of a region to which the non-ejection nozzle belongs is an integral multiple of the transporting distance.

5 Claims, 10 Drawing Sheets

FLUID EJECTING APPARATUS AND FLUID EJECTING METHOD

BACKGROUND

1. Technical Field

The present invention relates to fluid ejecting apparatuses and fluid ejecting methods.

2. Related Art

One example of a fluid ejecting apparatus is an ink jet printer equipped with nozzle arrays each having nozzles, which eject ink (fluid) toward a medium, arrayed in a predetermined direction. A known example of an ink jet printer is a printer that repeatedly performs operation for ejecting ink from the nozzles while moving the nozzle arrays in a certain moving direction that is orthogonal to the predetermined direction and operation for transporting the medium in the predetermined direction.

A printer of another known example performs printing operation by using white ink in addition to color inks, such as cyan, magenta, and yellow inks (for example, see JP-A-2002-38063). In such a printer, the white ink is used to perform a bed treatment so that a color image with good color development can be printed without being affected by the background color of the medium.

One example of a bed treatment using white ink involves printing a background image on the medium using the white ink and then printing a color image over the background image using the color inks. By printing the background image and subsequently printing the color image after a certain drying period, smearing of the ink can be prevented. However, variations in the drying period for the background image can undesirably result in the occurrence of uneven density in the image.

SUMMARY

An advantage of some aspects of the invention is that deterioration of the quality of an image can be minimized.

According to an aspect of the invention, a fluid ejecting apparatus includes a first nozzle array in which nozzles that eject a first fluid are arrayed in a predetermined direction; a second nozzle array arranged beside the first nozzle array in a moving direction orthogonal to the predetermined direction and in which nozzles that eject a second fluid are arrayed in the predetermined direction; and a control section that repeatedly performs operation for ejecting the fluids from the nozzles while relatively moving the first nozzle array, the second nozzle array, and a medium in the moving direction and operation for relatively shifting a relative position between the first nozzle array, the second nozzle array, and the medium towards one side in the predetermined direction. When performing normal image forming operation, the control section relatively shifts the relative position between the first nozzle array, the second nozzle array, and the medium towards the one side in the predetermined direction by a predetermined transporting distance. When forming a second image using the second fluid over a first image formed using the first fluid, the nozzles used for forming the second image are located towards the one side in the predetermined direction relative to the nozzles used for forming the first image. When performing image forming operation near an edge of the medium, a non-ejection nozzle included in the nozzles and from which the fluids are not ejected is located towards the one side in the predetermined direction relative to the nozzles used for forming the first image and is located towards the other side in the predetermined direction relative to the nozzles used for forming the second image. A length, in the predetermined direction, of a region to which the non-ejection nozzle belongs is an integral multiple of the predetermined transporting distance.

Other features of the invention will become apparent from this description and the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

General Outline of Disclosure

Figure 1:
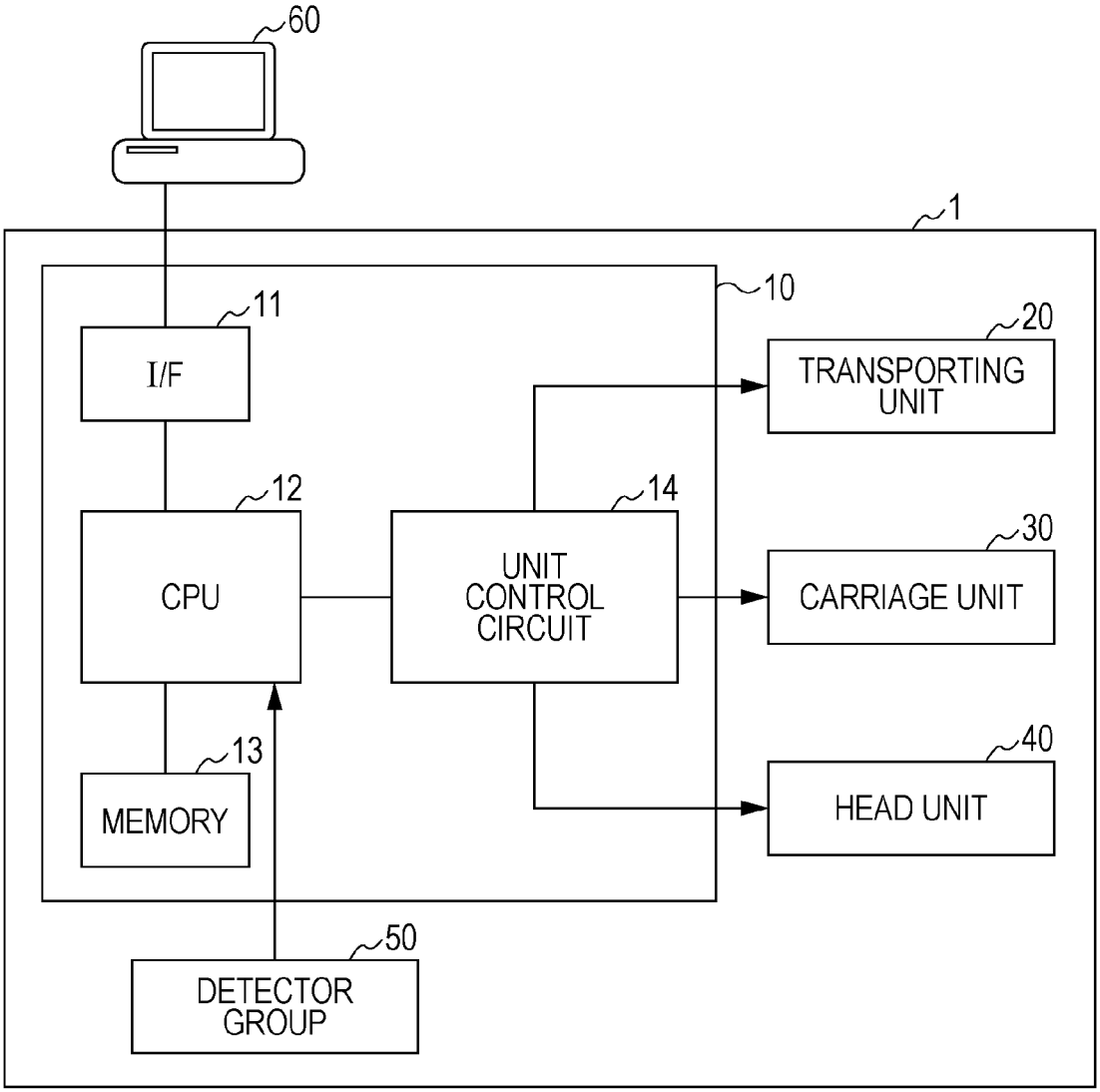
FIG. 1 is a block diagram of the overall configuration of a printer.

At least the following will become apparent from this description and the attached drawings.

Specifically, a fluid ejecting apparatus includes a first nozzle array in which nozzles that eject a first fluid are arrayed in a predetermined direction; a second nozzle array arranged beside the first nozzle array in a moving direction orthogonal to the predetermined direction and in which nozzles that eject a second fluid are arrayed in the predetermined direction; and a control section that repeatedly performs operation for ejecting the fluids from the nozzles while relatively moving the first nozzle array, the second nozzle array, and a medium in the moving direction and operation for relatively shifting a relative position between the first nozzle array, the second nozzle array, and the medium towards one side in the predetermined direction. When performing normal image forming operation, the control section relatively shifts the relative position between the first nozzle array, the second nozzle array, and the medium towards the one side in the predetermined direction by a predetermined transporting distance. When forming a second image using the second fluid over a first image formed using the first fluid, the nozzles used for forming the second image are located towards the one side in the predetermined direction relative to the nozzles used for forming the first image. When performing image forming operation near an edge of the medium, a non-ejection nozzle included in the nozzles and from which the fluids are not ejected is located towards the one side in the predetermined direction relative to the nozzles used for forming the first image and is located towards the other side in the predetermined direction relative to the nozzles used for forming the second image. A length, in the predetermined direction, of a region to which the non-ejection nozzle belongs is an integral multiple of the predetermined transporting distance.

With such a fluid ejecting apparatus, the drying period for the first image can be kept constant, thereby minimizing deterioration of image quality.

In the aforementioned fluid ejecting apparatus, when performing the normal image forming operation, a second non-ejection nozzle included in the nozzles and from which the fluids are not ejected is located towards the one side in the predetermined direction relative to the nozzles used for forming the first image and is located towards the other side in the predetermined direction relative to the nozzles used for forming the second image. A length, in the predetermined direction, of a region to which the second non-ejection nozzle belongs is an integral multiple of the predetermined transporting distance.

With such a fluid ejecting apparatus, the drying period for the first image can be kept constant, thereby minimizing deterioration of image quality.

In the aforementioned fluid ejecting apparatus, when performing image forming operation near an edge of the medium at the one side in the predetermined direction, the nozzles used for forming the first image are located towards the one side in the predetermined direction relative to the nozzles used for forming the first image during the normal image forming operation, and the non-ejection nozzle is located towards the one side in the predetermined direction relative to the second non-ejection nozzle corresponding to the normal image forming operation.

With such a fluid ejecting apparatus, the positional control range for the medium can be reduced in length.

In the aforementioned fluid ejecting apparatus, when performing image forming operation near an edge of the medium at the other side in the predetermined direction, the nozzles used for forming the second image are located towards the other side in the predetermined direction relative to the nozzles used for forming the second image during the normal image forming operation, and the non-ejection nozzle is located towards the other side in the predetermined direction relative to the second non-ejection nozzle corresponding to the normal image forming operation.

With such a fluid ejecting apparatus, the positional control range for the medium can be reduced in length.

In the aforementioned fluid ejecting apparatus, a length, in the predetermined direction, of a region to which the nozzles used for forming at least one of the first image and the second image belong is an integral multiple of the predetermined transporting distance.

With such a fluid ejecting apparatus, the number of nozzles that form each image (the number of times each nozzle array moves in the moving direction) can be kept constant.

In a fluid ejecting method performed by a fluid ejecting apparatus including a first nozzle array in which nozzles that eject a first fluid are arrayed in a predetermined direction, and a second nozzle array arranged beside the first nozzle array in a moving direction orthogonal to the predetermined direction and in which nozzles that eject a second fluid are arrayed in the predetermined direction, the fluid ejecting apparatus is configured to repeatedly perform operation for ejecting the fluids from the nozzles while relatively moving the first nozzle array, the second nozzle array, and a medium in the moving direction and operation for relatively shifting a relative position between the first nozzle array, the second nozzle array, and the medium towards one side in the predetermined direction. The fluid ejecting method includes relatively shifting the relative position between the first nozzle array, the second nozzle array, and the medium towards the one side in the predetermined direction by a predetermined transporting distance when performing normal image forming operation. When forming a second image using the second fluid over a first image formed using the first fluid, the nozzles used for forming the second image are located towards the one side in the predetermined direction relative to the nozzles used for forming the first image. When performing image forming operation near an edge of the medium, the fluids are not ejected from at least one of the nozzles located towards the one side in the predetermined direction relative to the nozzles used for forming the first image and located towards the other side in the predetermined direction relative to the nozzles used for forming the second image, the at least one of the nozzles belonging to a region with a length, in the predetermined direction, that is an integral multiple of the predetermined transporting distance.

With such a fluid ejecting method, the drying period for the first image can be kept constant, thereby minimizing deterioration of image quality.

Printing System

An embodiment of the invention will be described below with reference to an ink jet printer as the fluid ejecting apparatus. The ink jet printer in this case is, for example, a serial printer (referred to as "printer" hereinafter).

Figure 2A:
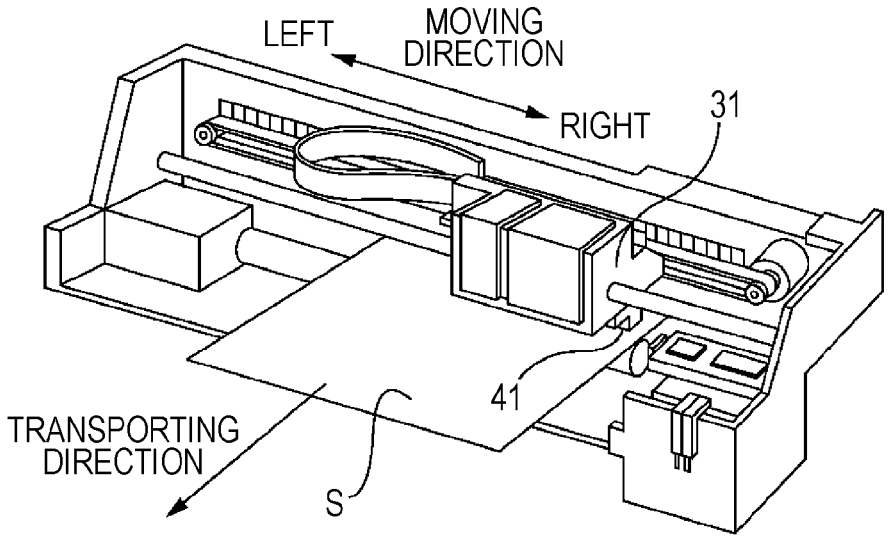
FIG. 2A is a schematic perspective view of the printer.
Figure 2B:
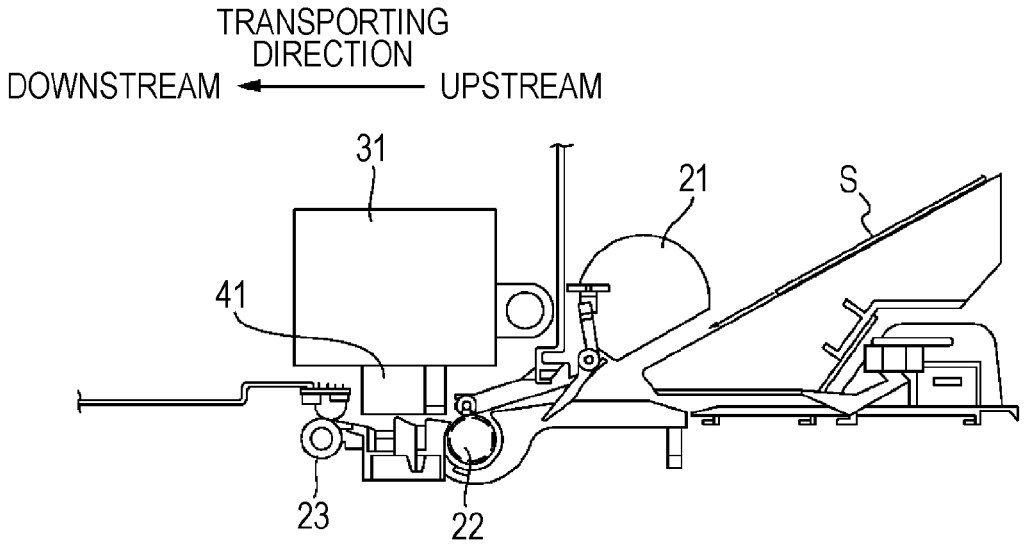
FIG. 2B is a schematic cross-sectional view of the printer.

FIG. 1 is a block diagram of the overall configuration of a printer 1. FIG. 2A is a schematic perspective view of the printer 1. FIG. 2B is a schematic cross-sectional view of the printer 1. When the printer 1 receives print data from a computer 60, which is an external device, a controller 10 in the printer 1 controls each of units provided therein (including a transporting unit 20, a carriage unit 30, and a head unit 40) so as to form an image on a medium S (such as paper or a film). A detector group 50 monitors the condition in the printer 1, and the controller 10 controls each unit on the basis of the detection result of the detector group 50. A program (printer driver) for converting image data output from an application program to print data is installed in the computer 60. The printer driver is stored in a storage medium (computer-readable storage medium), such as a flexible disk (FD) or a CD-ROM, or can be downloaded via the Internet.

The controller 10 (control section) is a control unit for controlling the printer 1. An interface section 11 is used for sending and receiving data between the computer 60, which is an external device, and the printer 1. A CPU 12 is an arithmetic processing unit for controlling the entire printer 1. A memory 13 is for ensuring, for example, a work area and an area for storing a program for the CPU 12. The CPU 12 controls each of the units via a unit control circuit 14 in accordance with the program stored in the memory 13.

The transporting unit 20 is configured to send the medium S to a printable position and to transport the medium S in a transporting direction (predetermined direction) by a predetermined transporting distance during printing, and includes a feed roller 21, a transporting roller 22, and a discharge roller 23. By rotating the feed roller 21, the medium S subject to printing operation is sent to the transporting roller 22. The controller 10 rotates the transporting roller 22 so as to positionally set the medium S at a print start position.

The carriage unit 30 is configured to move a head 41 in a direction (referred to as "moving direction" hereinafter) orthogonal to the transporting direction, and includes a carriage 31.

The head unit 40 is configured to eject ink towards the medium S, and includes the head 41. The head 41 is moved in the moving direction by the carriage 31. A lower surface of the head 41 is provided with a plurality of nozzles serving as ink ejecting sections, and each of the nozzles is provided with an ink chamber (not shown) containing ink.

Figure 3:
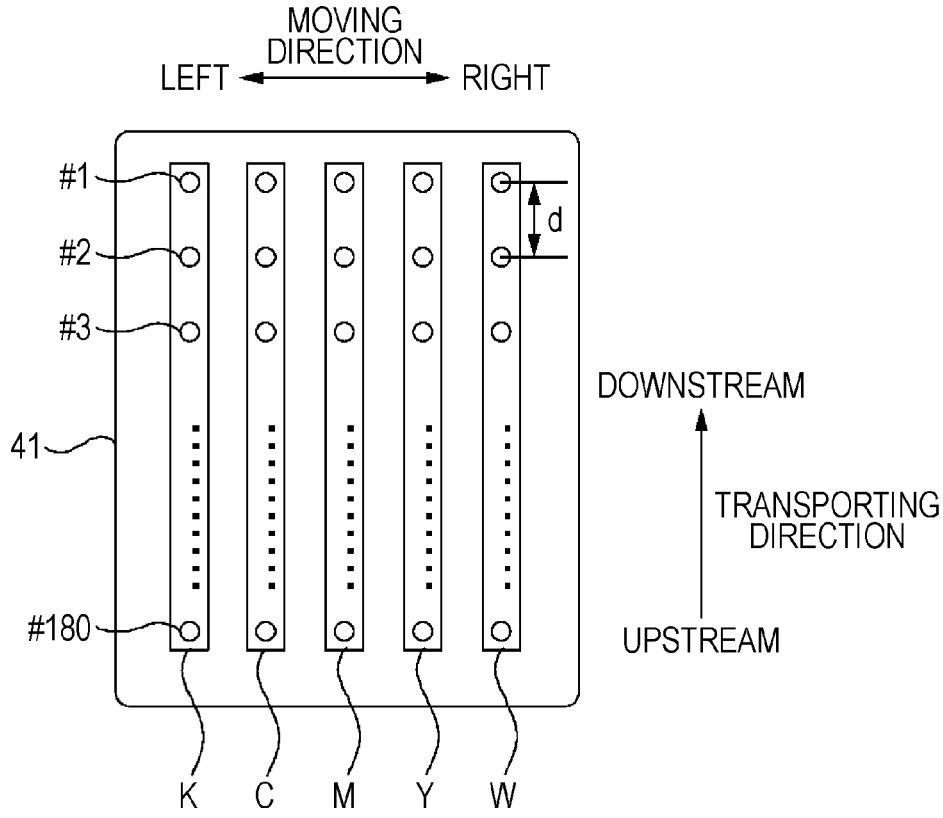
FIG. 3 illustrates nozzle arrays on the lower surface of a head.

FIG. 3 illustrates nozzle arrays on the lower surface of the head 41. The lower surface of the head 41 is provided with five nozzle arrays each having 180 nozzles arrayed at a predetermined pitch (nozzle pitch d) in the transporting direction. As shown in FIG. 3, a black nozzle array K that ejects black ink, a cyan nozzle array C that ejects cyan ink, a magenta nozzle array M that ejects magenta ink, a yellow nozzle array Y that ejects yellow ink, and a white nozzle array W that ejects white ink are arranged in that order in the moving direction. Regarding the 180 nozzles included in each nozzle array, each nozzle is given a number, starting from #1 for the downstream-most nozzle in the transporting direction to #180 for the upstream-most nozzle.

This printer 1 repeatedly performs a dot forming process (corresponding to image forming operation) for forming dots on the medium S by causing the head 41 moving in the moving direction to intermittently eject ink droplets onto the medium S and a transporting process (corresponding to transporting operation) for transporting the medium S in the transporting direction relative to the head 41. In consequence, new dots can be formed at positions on the medium S that are different from those of the dots formed in the previous dot forming process, whereby a two-dimensional image can be printed on the medium S. The operation in which the head 41 moves once in the moving direction while ejecting ink droplets will be referred to as "pass".

Print Modes

In the printer 1 according to this embodiment, a desired print mode can be selected from a "normal color mode", a "front-side print mode" and a "reverse-side print mode". A desired print mode can be selected by a user. The normal color mode is for directly printing a color image (including a monochrome image) on the medium S using four colors, i.e., black, cyan, magenta, and yellow. Specifically, in the normal color mode, the nozzle arrays (YMCK) for the four colors are used, whereas the white nozzle array W (corresponding to a first nozzle array or a second nozzle array) is not used. For the sake of convenience, the four color nozzle arrays (YMCK) will be collectively referred to as "color nozzle arrays Co" (corresponding to the first nozzle array or the second nozzle array).

On the other hand, in the front-side print mode and the reverse-side print mode, a background image of white ink (W) is printed over a color image of four inks (YMCK). This allows for better color development for the color image, and also prevents the reverse side of the color image from being transparent in the case where the medium S is a transparent medium. In the front-side print mode, a white background image is first printed onto a predetermined region on the medium S, and a color image is subsequently printed over the background image. Therefore, in the front-side print mode, the color image is viewed from the printed-surface side. In contrast, in the reverse-side print mode, a color image is first printed onto a predetermined region on the medium S, and a white background image is subsequently printed over the color image. Therefore, in the reverse-side print mode, the color image is viewed from the medium-surface side. Accordingly, when using a transparent medium, the reverse-side print mode may be selected.

Transporting Unit 20

Figure 4:
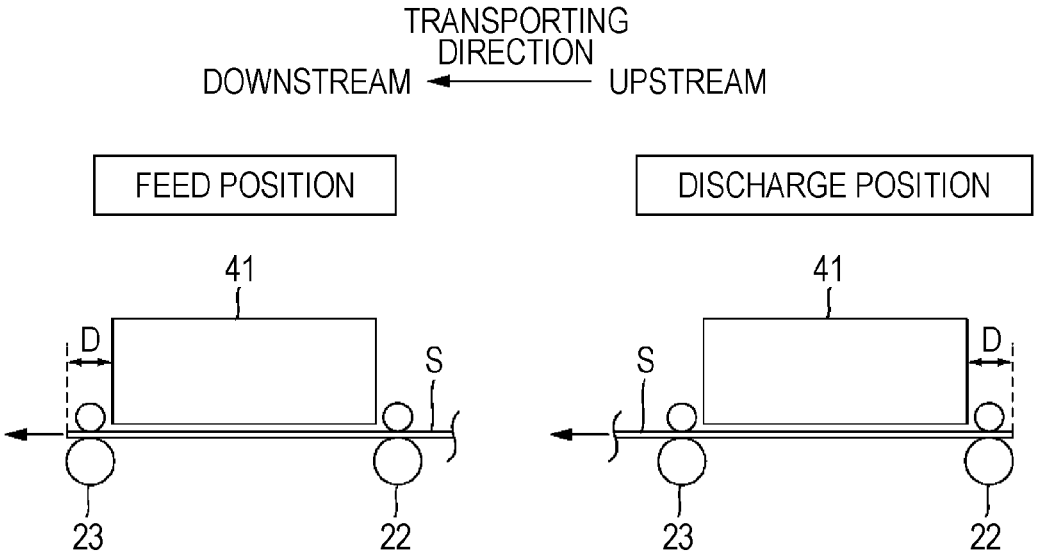
FIG. 4 illustrates a feed position and a discharge position of a medium.

FIG. 4 illustrates a feed position and a discharge position of the medium S achieved by the transporting unit 20 of the printer 1. In the printer 1 according to this embodiment, printing operation is performed while the medium S is held in a pinched state by both the transporting roller 22 and the discharge roller 23. This allows for stable transportation of the medium S. In the following description, of the two edges of the medium S in the transporting direction (i.e., the edges extending in the moving direction), the downstream-side edge in the transporting direction will be referred to as "leading edge", and the upstream-side edge in the transporting direction will be referred to as "trailing edge".

The left part of FIG. 4 illustrates the position (i.e., feed position) of the medium S relative to the head 41 when commencing printing operation. In this state, a point at which the leading edge of the medium S is positioned downstream by a distance D relative to a downstream end of the head 41 in the transporting direction will be referred to as "feed position (print start position)". At this feed position, the printing operation can be commenced while the medium S is held in a pinched state by the transporting roller 22 and the discharge roller 23.

On the other hand, the right part of FIG. 4 illustrates the position (i.e., discharge position) of the medium S relative to the head 41 at the end of the printing operation. In this state, a point at which the trailing edge of the medium S is positioned upstream by the distance D relative to an upstream end of the head 41 in the transporting direction will be referred to as "discharge position (print end position)". At this discharge position, the printing operation can be completed while the medium S is held in a pinched state by the transporting roller 22 and the discharge roller 23.

Printing Method of Comparative Example

Figure 5:
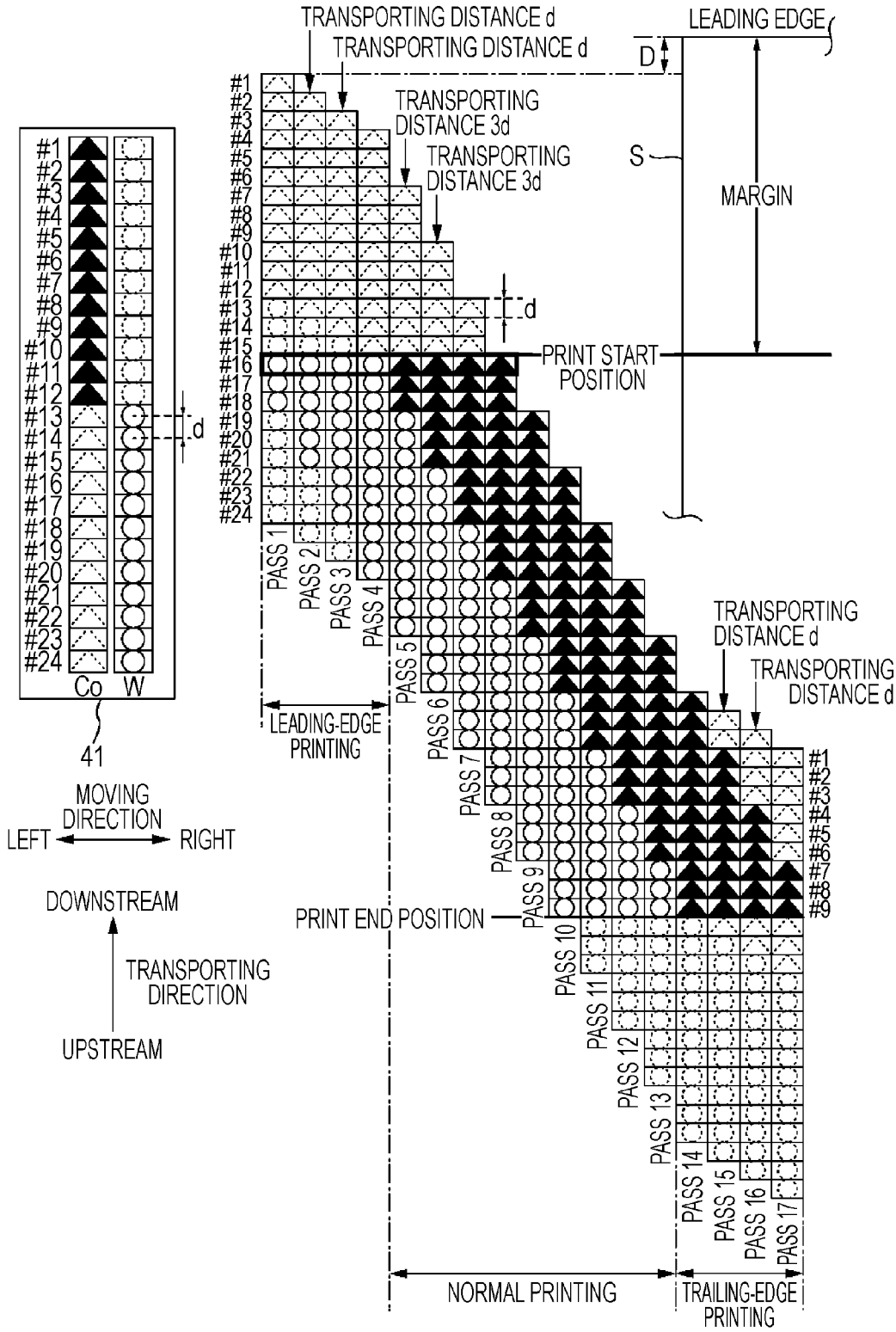
FIG. 5 illustrates a printing method of a comparative example in a front-side print mode.

FIG. 5 illustrates a printing method of a comparative example in the front-side print mode. For simplifying the description below, the number of nozzles included in each nozzle array will be reduced to 24. In the front-side print mode according to the comparative example, of the nozzles included in each of the color nozzle arrays Co (YMCK), half of the nozzles at the downstream side in the transporting direction (i.e., nozzles #1 to #12) are used, whereas the other half of the nozzles at the upstream side (i.e., nozzles #13 to #24) are not used. On the other hand, in the white nozzle array W, half of the nozzles at the downstream side in the transporting direction (i.e., nozzles #1 to #12) are not used, whereas the other half of the nozzles at the upstream side (i.e., nozzles #13 to #24) are used. In the following description, a nozzle to be used for printing will be referred to as "active nozzle" indicated by a filled-in triangle (▲) or a complete circle (○) in FIG. 5.

The right part of FIG. 5 illustrates the positional relationship between nozzles (ejection nozzles) that eject ink in each pass. In an actual printer, the medium S is transported downstream in the transporting direction relative to the head 41 (nozzles), but in the right part of FIG. 5, the position of the head 41 is shifted upstream in the transporting direction relative to the medium S. Furthermore, the active nozzles #1 to #12 of each color nozzle array Co and the active nozzles #13 to #24 of the white nozzle array W are illustrated as a single nozzle array.

The right part of FIG. 5 shows how the printing operation is performed on the medium S from start to finish. Specifically, the right part of FIG. 5 shows how the printing operation is performed from the leading edge to the trailing edge of the medium S. In a printing process performed near the leading edge (referred to as "leading-edge printing" hereinafter) and a printing process performed near the trailing edge (referred to as "trailing-edge printing" hereinafter), the transporting distance of the medium S differs from that in a printing process (referred to as "normal printing" hereinafter) performed a region other than the edges. In normal printing (passes 5 to 13) in FIG. 5, operation for forming an image while moving the head 41 in the moving direction and operation for transporting the medium S in the transporting direction by a distance 3*d* three times the nozzle pitch d are alternately repeated. Thus, a predetermined region of the medium S is made to first face the active nozzles (#13 to #24) of the white nozzle array W and to subsequently face the active nozzles (#1 to #12) of each color nozzle array Co. As a result, a background image is printed on the predetermined region of the medium S as a result of first passes and a color image is printed over the background image as a result of subsequent passes. In FIG. 5, since there are 12 active nozzles in each of the nozzle arrays Co and W, and the transporting distance of the medium S for each transporting operation is three times the nozzle pitch d, the background image and the color image are each printed in four passes. By printing images on the predetermined region of the medium S using different nozzles in multiple passes in this manner, property differences between the nozzles can be alleviated.

On the other hand, in leading-edge printing and trailing-edge printing, the transporting distance of the medium S is different from (reduced) from that in normal printing. Here, if the transporting distance of the medium S before and after the passes for printing near the leading edge of the medium S is smaller than the transporting distance 3*d* of the medium S for normal printing, the aforementioned passes correspond to passes for leading-edge printing. Therefore, in the right part of FIG. 5, passes 1 to 4 correspond to passes for leading-edge printing. Likewise, if the transporting distance of the medium S before and after the passes for performing printing near the trailing edge of the medium S is smaller than the transporting distance 3*d* of the medium S for normal printing, the aforementioned passes correspond to passes for trailing-edge printing. Therefore, in the right part of FIG. 5, passes 14 to 17 correspond to passes for trailing-edge printing. The transporting distance of the medium S for both leading-edge printing and trailing-edge printing is equal to the nozzle pitch d. When performing leading-edge printing and trailing-edge printing, since the transporting distance of the medium S is set smaller than that for normal printing, the number of nozzles (referred to as "ejection nozzles" hereinafter) that eject ink droplets at the start of the printing operation is small and is gradually increased, whereas the number of ejection nozzles is gradually decreased towards the end of the printing operation. Therefore, for example, of the active nozzles (#13 to #24) of the white nozzle array W, there are nozzles (#19 to #24) that do not eject ink droplets even if these nozzles are located upstream of the print start position (i.e., the position of the nozzle #16 in pass 1).

Accordingly, in leading-edge printing and trailing-edge printing, the transporting distance of the medium S is different from that in normal printing, and the printing operation is performed by selecting nozzles that eject ink droplets, from the active nozzles. Thus, similar to the midsection of the medium S, the leading edge and the trailing edge of the medium S receive ink droplets ejected toward the predetermined region from the ejection nozzles (○) of the white nozzle array W in the first four passes, and then ink droplets are ejected over the background image from the ejection nozzles (▲) of each color nozzle array Co in the subsequent four passes. In other words, a color image can be printed over the background image.

The nozzles arrayed in the moving direction in the right part of FIG. 5 correspond to nozzles that form dot rows (referred to as "raster lines" hereinafter) extending in the moving direction. For example, four white nozzles (○) and four color nozzles (▲) (i.e., nozzles surrounded by a bold frame) arrayed in the moving direction are immediately upstream of the print start position, and this indicates that the background image and the color image are each printed in four passes. In the right part of FIG. 5, there are four white nozzles (○) and four color nozzles (▲) arrayed in the moving direction in the entire region from the print start position to the print end position. This also makes it apparent that images are formed in leading-edge printing and trailing-edge printing in a similar manner to normal printing.

To summarize the above description, when performing the printing method of the comparative example in the front-side print mode, the upstream half of the nozzles of the white nozzle array W (i.e., nozzles #13 to #24) are used for printing the background image, and the downstream half of the nozzles of each color nozzle array Co (i.e., nozzles #1 to #12) are used for printing the color image. Thus, the background image can be printed on the predetermined region of the medium S in the first passes and the color image can be printed over the background image in the subsequent passes. Although not shown in the drawings, when performing the printing method of the comparative example in the reverse-side print mode, the downstream half of the nozzles of the white nozzle array W (i.e., nozzles #1 to #12) are used for printing the background image and the upstream half of the nozzles of each color nozzle array Co (i.e., nozzles #13 to #24) are used for printing the color image. In the normal color mode, all of the nozzles in each color nozzle array Co may be used, or half of the nozzles in each color nozzle array Co may be used, as in the front-side print mode.

Accordingly, in the printing method of the comparative example, when printing the background image and the color image one on top of the other, the nozzles to be used for printing a first image are those located upstream in the transporting direction relative to the nozzles to be used for printing a second image. This can vary the passes for printing the background image and the color image one on top of the other. However, with the printing method of the comparative example, the printing of the second image (i.e., the color image) commences from a pass subsequent to the passes having completed the printing of the first image (i.e., the background image in the case of FIG. 5). Specifically, in the printing method of the comparative example, the drying period for the first image is relatively short (whether performing leading-edge printing, trailing-edge printing, or normal printing) and is only equivalent to the time required for a single medium-transporting operation. Therefore, if the dried state of the first-printed image is poor (for example, if the dried state of the ink is poor or if the absorbability of the ink on the medium S is poor), the subsequent color image would be printed before the first-printed image is completely dry, causing the ink to smear and thus resulting in deteriorated image quality of the printed image. In light of this, the embodiment according to the invention prevents the printed image from smearing when printing a background image and a color image one on top of the other.

Printing Method According to Present Embodiment

Figure 6:
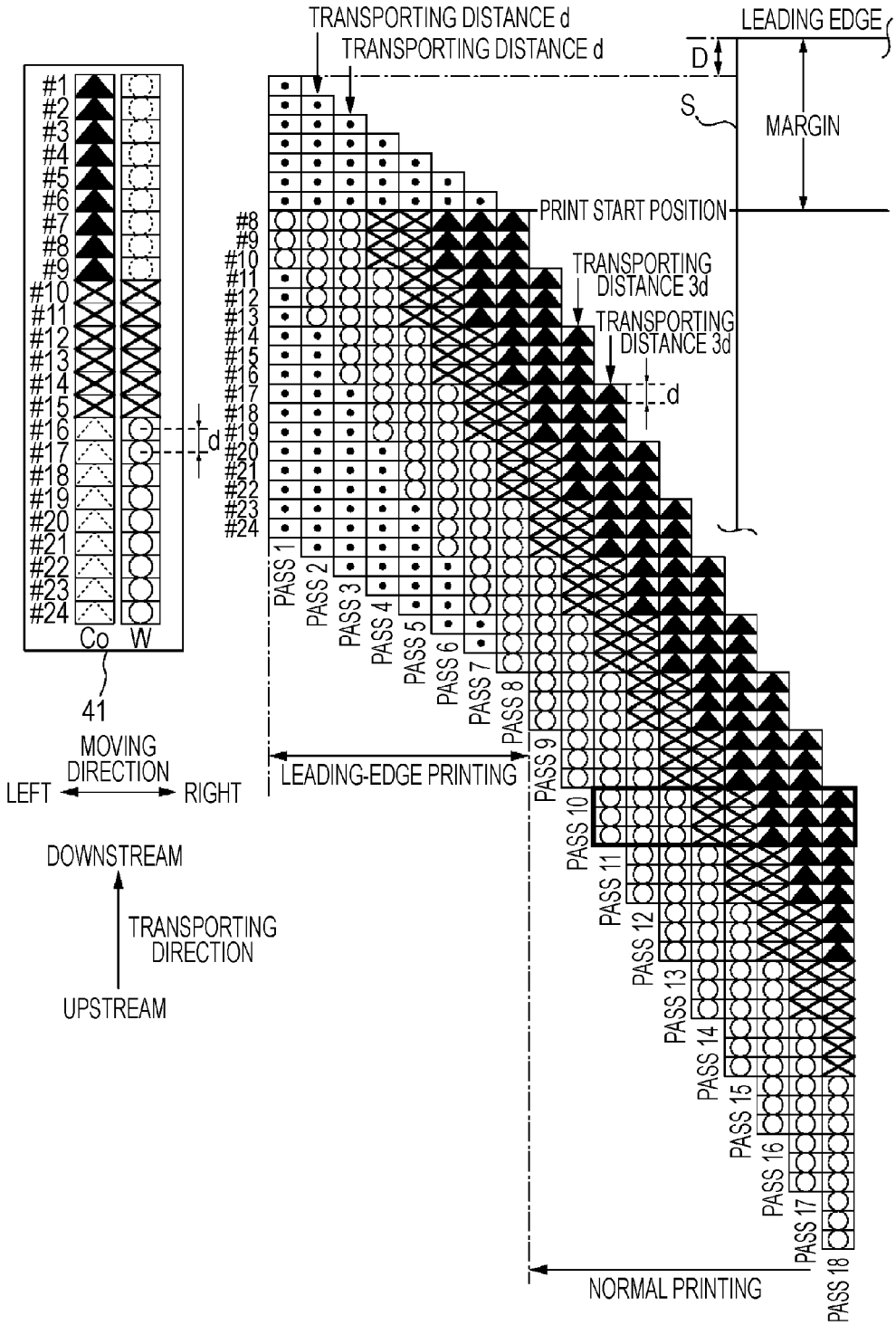
FIG. 6 illustrates how leading-edge printing in the front-side print mode is performed in an embodiment according to the invention.
Figure 7:
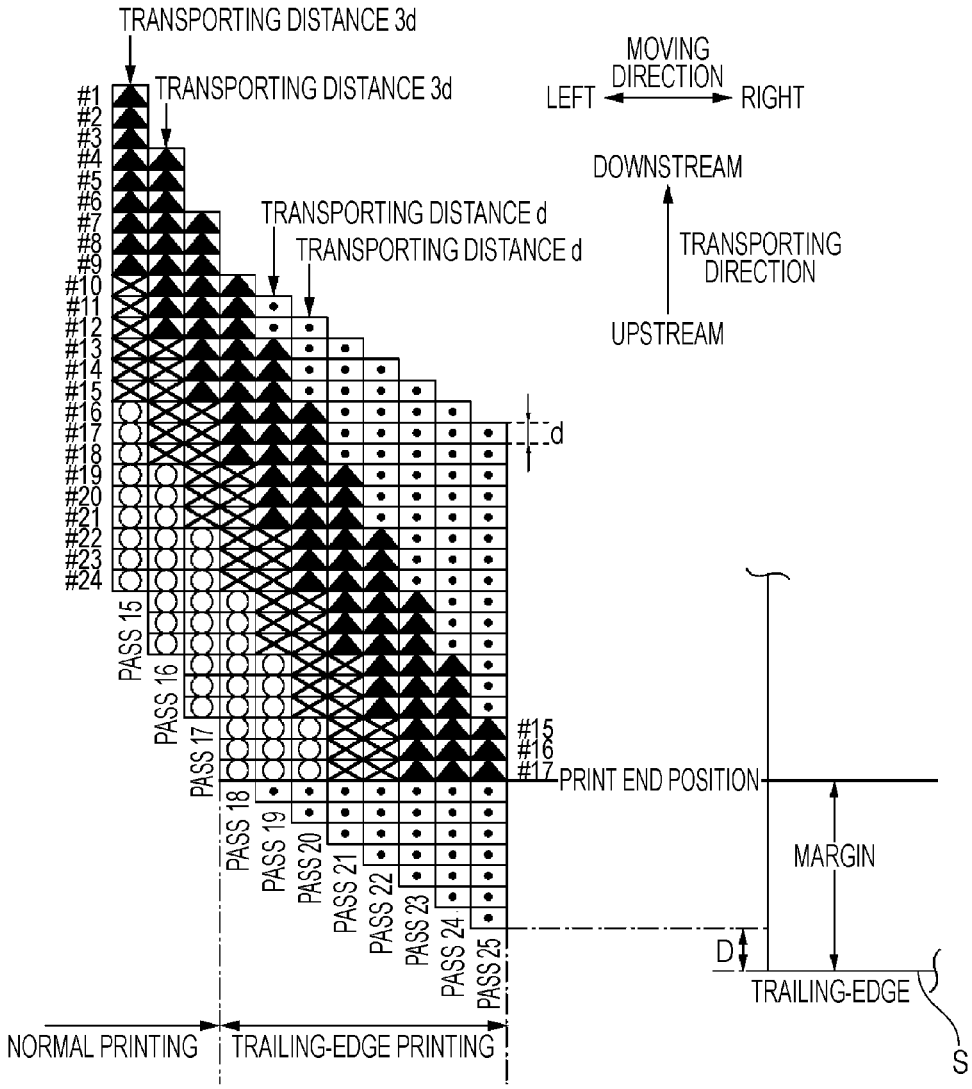
FIG. 7 illustrates how trailing-edge printing in the front-side print mode is performed in the embodiment.

FIG. 6 illustrates how leading-edge printing in the front-side print mode is performed in accordance with the printing method according to this embodiment. FIG. 7 illustrates how trailing-edge printing in the front-side print mode is performed in accordance with the printing method according to this embodiment. As in the printing method of the comparative example, the transporting distance of the medium S during normal printing (corresponding to normal image forming operation) is three times (3*d*) the nozzle pitch, and the transporting distance d of the medium S during leading-edge printing and trailing-edge printing (corresponding to image forming operation performed on the edges of the medium S) is set smaller than the transporting distance 3*d* of the medium S for normal printing in the printing method according to this embodiment. In FIGS. 6 and 7, passes 1 to 8 correspond to leading-edge printing, and passes 18 to 25 correspond to trailing-edge printing.

When performing normal printing, of the nozzles included in each color nozzle array Co of the head 41 shown in the left part of FIG. 6, nine nozzles (#1 to #9) at the downstream side in the transporting direction are used as nozzles for the color image, and of the nozzles included in the white nozzle array W, nine nozzles (#16 to #24) at the upstream side in the transporting direction are used as nozzles for the background image. Furthermore, six nozzles (#10 to #15 indicated by x) for drying are provided between the color-image-forming nozzles (▲) and the background-image-forming nozzles (○). Therefore, in normal printing, the predetermined region on the medium S is made to first face the upstream-side nozzles of the white nozzle array W, then to face the drying nozzles (corresponding to non-ejection nozzles) in the mid-section in the transporting direction, and finally to face the downstream-side nozzles of each color nozzle array Co. Ink droplets are not ejected from the drying nozzles. Therefore, a period in which the predetermined region of the medium S faces the drying nozzles can be used as the drying period for the image, whereby the drying period from the end of printing of the background image to the start of printing of the color image can be made longer, as compared with the printing method of the comparative example (FIG. 5).

Furthermore, the printing method according to this embodiment differs from the printing method of the comparative example (FIG. 5) in that the nozzles used in leading-edge printing and trailing-edge printing are not fixed. In the printing method of the comparative example, the nozzles are used in normal printing are similarly used in leading-edge printing and trailing-edge printing. Specifically, the nozzles used for printing the background image are the upstream half of the nozzles of the white nozzle array W (i.e., nozzles #13 to #24), and the nozzles used for printing the color image are the downstream half of the nozzles of each color nozzle array Co (i.e., the nozzles #1 to #12). Therefore, the print start position corresponds to the nozzle #16 in pass 1, and the print end position corresponds to the nozzle #9 in pass 17. When printing two images one on top of the other, the nozzles for printing the first image are set as nozzles located upstream in the transporting direction relative to the nozzles for printing the second image. For this reason, if the same nozzles are used in leading-edge printing, trailing-edge printing, and normal printing, as in the printing method of the comparative example, the nozzles at the upstream side are used at the start of the printing operation, and the nozzles at the downstream side are used at the end of the printing operation.

As shown in FIG. 4, in this printer, printing operation is performed while the medium S is held in a pinched state by both the transporting roller 22 and the discharge roller 23. Therefore, as shown in FIG. 5, in the printing method of the comparative example, the amount of margin near the leading edge of the medium S is relatively large. In detail, the amount of margin near the leading edge of the medium S is the sum of a protruding amount D of the medium S from the head 41 and a distance equivalent to 15 nozzles including the active nozzles (#1 to #12) of each color nozzle array Co. Although not shown in the drawings, the amount of margin near the trailing edge of the medium S is also relatively large, and is the sum of a distance equivalent to 15 nozzles including the active nozzles (#13 to #24) of the white nozzle array W and the protruding amount D of the medium S from the head 41.

In contrast, in the printing method according to this embodiment, nozzles located downstream (towards one side) relative to the nozzles (#16 to #24) for printing the background image in normal printing are used for printing the background image in leading-edge printing, and nozzles located upstream (towards the other side) relative to the nozzles (#1 to #9) for printing the color image in normal printing are used for printing the color image in trailing-edge printing.

In detail, as shown in FIG. 6, the nozzles #8 to #10 located downstream relative to the background-image-forming nozzles (#16 to #24) used in normal printing are set as nozzles for pass 1. Subsequently, in passes 1 to 8 for leading-edge printing, the number of background-image-forming nozzles (○) is increased while the position of the background-image-forming nozzles is shifted upstream in the transporting direction. Therefore, the print start position in this embodiment corresponds to the nozzle #8 in pass 1. Consequently, in this embodiment, the amount of margin near the leading edge of the medium S is the sum of the protruding amount D of the medium S from the head 41 and a distance equivalent to seven nozzles, and is thus smaller than the amount of margin in the printing method of the comparative example (FIG. 5).

Similarly, as shown in FIG. 7, trailing-edge printing is performed using nozzles located upstream relative to the color-image-forming nozzles (#1 to #9) used in normal printing. In passes 18 to 25 for trailing-edge printing, the number of color-image-forming nozzles (▲) is decreased while the position of the color-image-forming nozzles is shifted upstream in the transporting direction. Therefore, the print end position in this embodiment corresponds to the nozzle #17 in pass 25. Consequently, in this embodiment, the amount of margin near the trailing edge of the medium S is the sum of the protruding amount D of the medium S from the head 41 and a distance equivalent to seven nozzles, and is thus smaller than the amount of margin in the printing method of the comparative example.

Figure 8A:
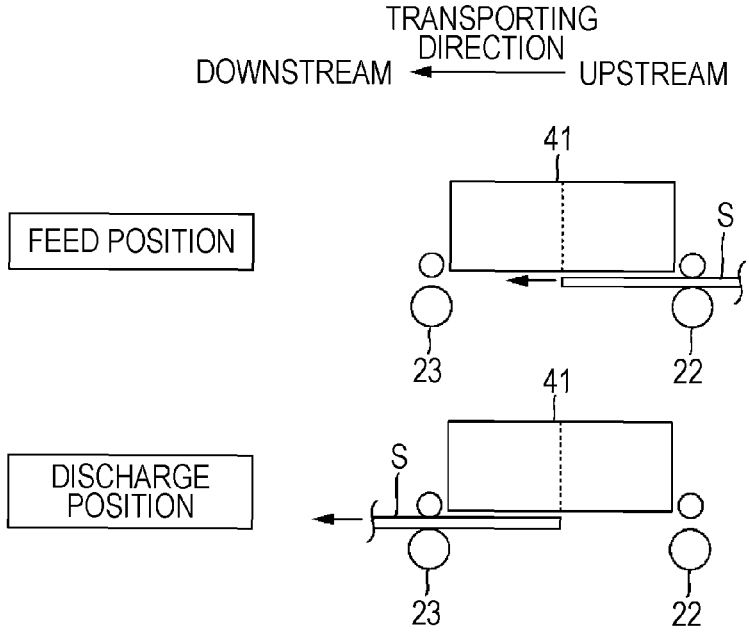
FIGS. 8A and 8B illustrate the feed position and the discharge position of printers with different transporting units.
Figure 8B:
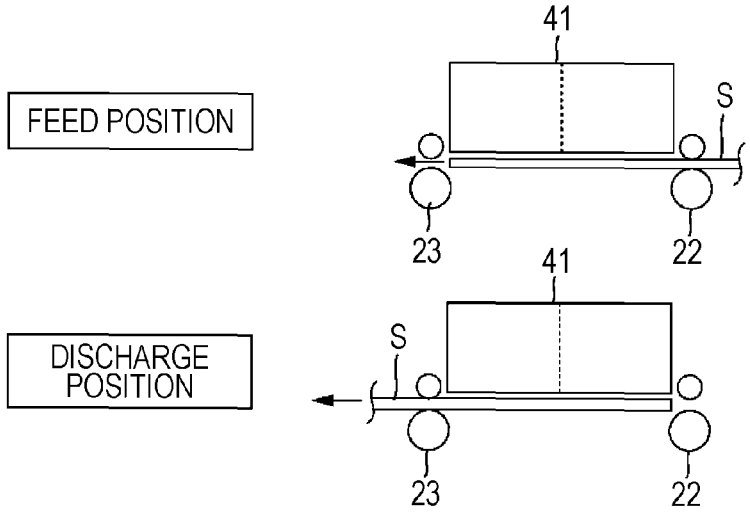

FIGS. 8A and 8B illustrate the feed position and the discharge position of the medium S in different printers with different transporting units 20. Although the printer described above as an example performs printing operation while the medium S is held in a pinched state by both the transporting roller 22 and the discharge roller 23, as shown in FIG. 4, the invention is not limited to this configuration. As shown in FIGS. 8A and 8B, the printer may be of a type in which the feed position and the discharge position are variable. In the printing method of the comparative example (FIG. 5), the nozzles at the upstream side are used at the start of printing operation, and the nozzles at the downstream side are used at the end of the printing operation. Therefore, the feed position and the discharge position of the medium S are at positions shown in FIG. 8A. In this case, although the amount of margin of the medium S is small, the positional control range for the medium S (i.e., a distance by which the medium S is positionally controlled in the transporting direction) is undesirably long. This can cause a transporting error to occur readily. For example, in the case where the position of the medium S in the transporting direction is to be controlled on the basis of the rotational amount (transporting distance) of the transporting roller 22 after a sensor located upstream in the transporting direction detects the leading edge of the medium S, a possibility of a transporting error becomes higher as the transportation control range becomes longer. Furthermore, when the feed position and the discharge position are set at the positions shown in FIG. 8A, the protruding amount of the medium S from the head 41 increases, resulting in an increase in size of the transporting unit 20 or a higher possibility of jamming of the medium S.

In contrast, in the printing method according to this embodiment (FIGS. 6 and 7), the nozzles at the downstream side are used at the start of printing operation and the nozzles at the upstream side are used at the end of the printing operation, so that the feed position and the discharge position of the medium S are at positions shown in FIG. 8B. In other words, with the printing method according to this embodiment, the positional control range of the medium S can be reduced in length. Thus, a transporting error can be minimized, and the protruding amount of the medium S from the head 41 can be reduced.

Furthermore, in the printing method according to this embodiment, when performing leading-edge printing and trailing-edge printing, the nozzles used are different from those used in normal printing. Since nozzles not used in normal printing can be used in leading-edge printing and trailing-edge printing, thickening of the ink can be minimized. In consequence, defective ejection from the nozzles can be minimized, and the number of times for cleaning the nozzles can be reduced. Moreover, since more various kinds of nozzles are used in the printing method according to this embodiment, property differences between the nozzles can be alleviated.

In leading-edge printing, as the position of the background-image-forming nozzles (○) is shifted upstream in the transporting direction, the drying nozzles (x) and the color-image-forming nozzles (▲) become active. For example, although the color-image-forming nozzles used in leading-edge printing in passes 6 to 8 are located at the downstream side in the transporting direction, the color-image-forming nozzles used in normal printing (i.e., the nozzles #1 to #9) are also located at the downstream side in the transporting direction. On the other hand, the drying nozzles in normal printing (i.e., the nozzles #10 to #15) are located in the midsection of the nozzle array, whereas the drying nozzles in leading-edge printing (e.g., the nozzles #5 to #7 in pass 4) are located at the downstream side of the nozzle array.

In trailing-edge printing, as the position of the color-image-forming nozzles (▲) is shifted upstream in the transporting direction, the background-image-forming nozzles (○) and the drying nozzles (x) become inactive. For example, although the background-image-forming nozzles used in trailing-edge printing in passes 18 to 20 are located at the upstream side in the transporting direction, the background-image-forming nozzles used in normal printing (i.e., the nozzles #16 to #24) are also located at the upstream side in the transporting direction. On the other hand, the drying nozzles in normal printing (i.e., the nozzles #10 to #15) are located in the midsection of the nozzle array, whereas the drying nozzles in trailing-edge printing (e.g., the nozzles #18 to #20 in pass 22) are located at the upstream side of the nozzle array.

In other words, similar to the background-image-forming nozzles (○) used in leading-edge printing and the color-image-forming nozzles (▲) used in trailing-edge printing, the drying nozzles (x) in leading-edge printing and trailing-edge printing are different from the drying nozzles in normal printing (i.e., the nozzles #10 to #15).

In the printing method according to this embodiment, the transporting distance 3*d* of the medium S during normal printing is three times the nozzle pitch d, and when performing normal printing, the medium S is shifted downstream relative to the nozzles (head 41) by a distance equivalent to three nozzles in each pass. Therefore, during normal printing, the printing operation is commenced and completed for every region (i.e., every region equivalent to three cells in the drawings) with three raster lines (dot arrays extending in the moving direction) formed on the medium S. For example, this is apparent from the right part of FIG. 6 that the upstream-most nozzle (○) and the downstream-most nozzle (▲) in pass 9 in normal printing are shifted upstream in the transporting direction by a distance equivalent to three raster lines (three cells) in pass 10. Furthermore, similar to the ejection nozzles that form the respective images, it is apparent from the right part of FIG. 6 that the drying nozzles (x) between the ejection nozzles are shifted upstream by three nozzles (three cells) for each pass.

Therefore, in normal printing, the number of nozzles for printing each of the background image and the color image is set equal to the number of nozzles belonging to a region with a length corresponding to an integral multiple of the transporting distance 3*d* of the medium S. In this case, as shown in FIG. 6, the number of nozzles for printing each of the background image and the color image is set equal to the number of nozzles belonging to a region with a length (9*d*) three times the transporting distance 3*d* of the medium S, that is, nine nozzles. Thus, the number of passes for printing each image during normal printing can be kept constant at three times (i.e., three nozzles). Likewise, in normal printing, the number of drying nozzles is set equal to the number of nozzles belonging to a region with a length corresponding to an integral multiple of the transporting distance 3*d* of the medium S. In this case, as shown in FIG. 6, the number of drying nozzles is set equal to the number of nozzles belonging to a region with a length (6*d*) that is twice as long as the transporting distance 3*d* of the medium S, that is, six nozzles. Thus, the number of passes in which the medium S faces the drying nozzles during normal printing can be kept constant at two times. This is also apparent from the nozzles surrounded by a bold frame in the normal printing region in which three white nozzles, two drying nozzles, and three color nozzles are arrayed in the moving direction.

In other words, when performing normal printing, the background image and the color image are each printed using the number of nozzles (nine nozzles) belonging to a region with a length corresponding to an integral multiple of (three times in FIG. 6) the transporting distance 3*d* of the medium S (for normal printing). Nozzles (six nozzles) located downstream of the nozzles for printing the background image (i.e., the nozzles #16 to #24) and located upstream of the nozzles for printing the color image (i.e., the nozzles #1 to #9) and belonging to a region with a length corresponding to an integral multiple of (twice as long as, in FIG. 6) the transporting distance 3*d* of the medium S are used as the drying nozzles (#10 to #15). In consequence, the background image and the color image can be printed in the same number of passes (i.e., the same number of nozzles) in the entire image region formed as the result of normal printing. Moreover, the number of passes in which the medium S faces the drying nozzles between the printing of the background image and the printing of the color image can be kept constant.

Accordingly, in normal printing according to this embodiment, two passes (sometimes referred to as "drying passes" hereinafter) in which ink droplets are not ejected can be provided from the end of printing of the background image to the start of printing of the color image. In consequence, the drying period for the background image can be made longer, as compared with the printing method of the comparative example (FIG. 5), thereby preventing the image from smearing. Even if a long drying period can be ensured for the background image, if there are variations in the drying period (the number of drying passes) depending on different locations of the background image, the degree of smearing between the background image and the color image may vary depending on the location of the image. This can lead to occurrence of uneven density in the image. In contrast, in this embodiment, the drying period (the number of drying passes) for the background image can be kept constant over the entire image region formed as the result of normal printing. In consequence, the occurrence of uneven density in the image caused by variations in the drying period can be reduced.

With regard to leading-edge printing and trailing-edge printing, it is preferable that printing operation (dot forming operation) be performed in the same manner as in normal printing as much as possible. Specifically, during leading-edge printing and trailing-edge printing, the printing operation is preferably commenced and completed for every region (equivalent to three cells) with three raster lines formed on the medium S. However, when performing leading-edge printing and trailing-edge printing, the dots cannot be filled unless the transporting distance d of the medium S is set smaller than the transporting distance 3*d* for normal printing. Therefore, in leading-edge printing, the number of ejection nozzles is increased in each pass, while up to two nozzles shifted upstream are used. For example, in pass 1 in FIG. 6, the nozzles #8 to #10 of the white nozzle array W are used, and in pass 2, the nozzles #7 to #12 are used, and in pass 3, the nozzles #6 to #14 are used. As a result, the transporting distance of the medium S for leading-edge printing is equivalent to the nozzle pitch d (equivalent to one cell), but the printing operation is commenced and completed for every region (equivalent to three cells) with three raster lines formed on the medium S, as in normal printing. This is apparent from the right part of FIG. 6 that the upstream-most nozzle of the ejection nozzles in each pass is shifted upstream by three cells. The drying nozzles (x) and the color-image-forming nozzles (▲) also used with the progression of the passes are similarly shifted upstream by three cells for every pass, as shown in the right part of FIG. 6.

On the other hand, in trailing-edge printing, the number of ejection nozzles is decreased in each pass, while the downstream-most nozzle of the ejection nozzles is set as a nozzle shifted upstream by two nozzles. For example, in pass 23 in FIG. 7, the nozzles #11 to #19 of each color nozzle array Co are used, and in pass 24, the nozzles #13 to #18 of the color nozzle array Co are used, and in pass 25, the nozzles #15 to #17 of the color nozzle array Co are used. As a result, the transporting distance of the medium S for trailing-edge printing is equivalent to the nozzle pitch d (equivalent to one cell), but the printing operation is commenced and completed for every region (equivalent to three cells) with three raster lines on the medium S, as in normal printing. This is apparent from FIG. 7 that the downstream-most nozzle of the ejection nozzles in each pass is shifted upstream by three cells. The number of background-image-forming nozzles (○) and the number of drying nozzles (x) are also decreased with the progression of the passes, and these nozzles are similarly shifted upstream by three cells for every pass, as shown in FIG. 7.

Accordingly, in leading-edge printing and trailing-edge printing, the printing operation is commenced and completed for every region (equivalent to three cells) with three raster lines formed on the medium S, as in normal printing. Specifically, the number of raster lines formed in each pass during normal printing is equal to the number of raster lines formed in each pass during leading-edge printing and the trailing-edge printing. Therefore, in leading-edge printing and the trailing-edge printing, the number of nozzles for printing each of the background image and the color image may be set equal to the number of nozzles belonging to a region with a length corresponding to an integral multiple of the transporting distance 3*d* (corresponding to a predetermined transporting distance) of the medium S. For leading-edge printing and trailing-edge printing, the number of nozzles for forming each image is increased or decreased in a gradual manner.

In detail, when performing leading-edge printing in this embodiment (FIG. 6), for example, three background-image-forming nozzles are used in pass 1, six background-image-forming nozzles are used in pass 2, nine background-image-forming nozzles are used in pass 3, three color-image-forming nozzles are used in pass 6, six color-image-forming nozzles are used in pass 7, and nine color-image-forming nozzles are used in pass 8. In other words, the number of background-image-forming nozzles and the number of color-image-forming nozzles in each pass are incremented by the number of nozzles corresponding to the transporting distance 3*d* for normal printing, instead of the transporting distance d for leading-edge printing. Specifically, in FIG. 6, the number of nozzles is incremented by three. In addition to the number of nozzles for forming images, the number of drying nozzles is also incremented by the number of nozzles (three nozzles) corresponding to the transporting distance 3*d* for normal printing. For example, three drying nozzles (a single multiple) are used in pass 4, while six drying nozzles (a double multiple) are used in pass 5. In other words, in leading-edge printing according to this embodiment, the length, in the transporting direction, of the region to which the nozzles for forming each image in each pass belong and the length, in the transporting direction, of the region to which the drying nozzles in each pass belong are set as an integral multiple of the transporting distance 3*d* for normal printing.

Consequently, the number of passes for forming each image during leading-edge printing can be kept constant at three times (that is, the number of nozzles can be kept constant at three), as in normal printing, and the number of drying passes can also be kept constant at two times (that is, the number of drying nozzles can be kept constant at two). This is apparent from FIG. 6 in which each array of nozzles in the moving direction in the leading-edge printing region include three white nozzles, two drying nozzles, and three color nozzles.

Likewise, when performing trailing-edge printing (FIG. 7), for example, nine background-image-forming nozzles are used in pass 18, six background-image-forming nozzles are used in pass 19, three background-image-forming nozzles are used in pass 20, nine color-image-forming nozzles are used in pass 23, six color-image-forming nozzles are used in pass 24, and three color-image-forming nozzles are used in pass 25. In other words, the number of background-image-forming nozzles and the number of color-image-forming nozzles in each pass are decremented by the number of nozzles (three nozzles) corresponding to the transporting distance 3*d* for normal printing, instead of the transporting distance d for trailing-edge printing. Moreover, the number of drying nozzles is also decremented by the number of nozzles (three nozzles) corresponding to the transporting distance 3*d* for normal printing. For example, six drying nozzles (a double multiple) are used in pass 21, while three drying nozzles (a single multiple) are used in pass 22. In other words, in trailing-edge printing, the length, in the transporting direction, of the region to which the nozzles for forming each image in each pass belong and the length, in the transporting direction, of the region to which the drying nozzles in each pass belong are set as an integral multiple of the transporting distance 3*d* for normal printing. Consequently, the number of passes for printing each image during trailing-edge printing can be kept constant at three times (that is, the number of nozzles can be kept constant at three), as in normal printing, and the number of drying passes can also be kept constant at two times (that is, the number of drying nozzles can be kept constant at two). This is apparent from FIG. 7 in which each array of nozzles in the moving direction in the trailing-edge printing region include three white nozzles, two drying nozzles, and three color nozzles.

To summarize the above description, nozzles located downstream of the background-image-forming nozzles (○) and located upstream of the color-image-forming nozzles (▲) are used as drying nozzles (x) also in leading-edge printing and trailing-edge printing, so that drying passes can be provided between the printing of the background image and the printing of the color image. In consequence, the drying period of the background image can be made longer, as compared with leading-edge printing and trailing-edge printing in the comparative example (FIG. 5), thereby preventing the image from smearing.

Furthermore, in leading-edge printing and trailing-edge printing, the length, in the transporting direction, of the region to which the nozzles for forming each image in each pass belong is an integral multiple of the transporting distance 3*d* of the medium S for normal printing. Consequently, the number of passes (the number of nozzles) for printing each image in leading-edge printing and trailing-edge printing can be kept constant, and the number of passes for forming each image in leading-edge printing and trailing-edge printing can be set equal to the number of passes for forming each image in normal printing, thereby facilitating the control of the printing operation.

Furthermore, in leading-edge printing and trailing-edge printing, the length, in the transporting direction, of the region to which the drying nozzles belong is an integral multiple of the transporting distance 3*d* of the medium S for normal printing. Consequently, the number of drying passes (two passes) in leading-edge printing and trailing-edge printing can be kept constant. Specifically, in leading-edge printing and trailing-edge printing, since the drying period for the background image is kept constant, the occurrence of uneven density in the formed images can be reduced. Moreover, in this embodiment, since the number of drying passes in leading-edge printing and trailing-edge printing is set equal to the number of drying passes in normal printing, the drying period for the background image can be kept constant over the entire image region formed as the result of leading-edge printing, trailing-edge printing, and normal printing. In consequence, the occurrence of uneven density can be reduced.

The selection of the nozzles, for forming each of the background image and the color image, and the drying nozzles from the nozzles included in each nozzle array may be implemented by the printer driver when creating print data, or may be implemented when the controller 10 in the printer 1 having received the print data from the printer driver allocate the print data to the respective nozzles.

Figure 9:
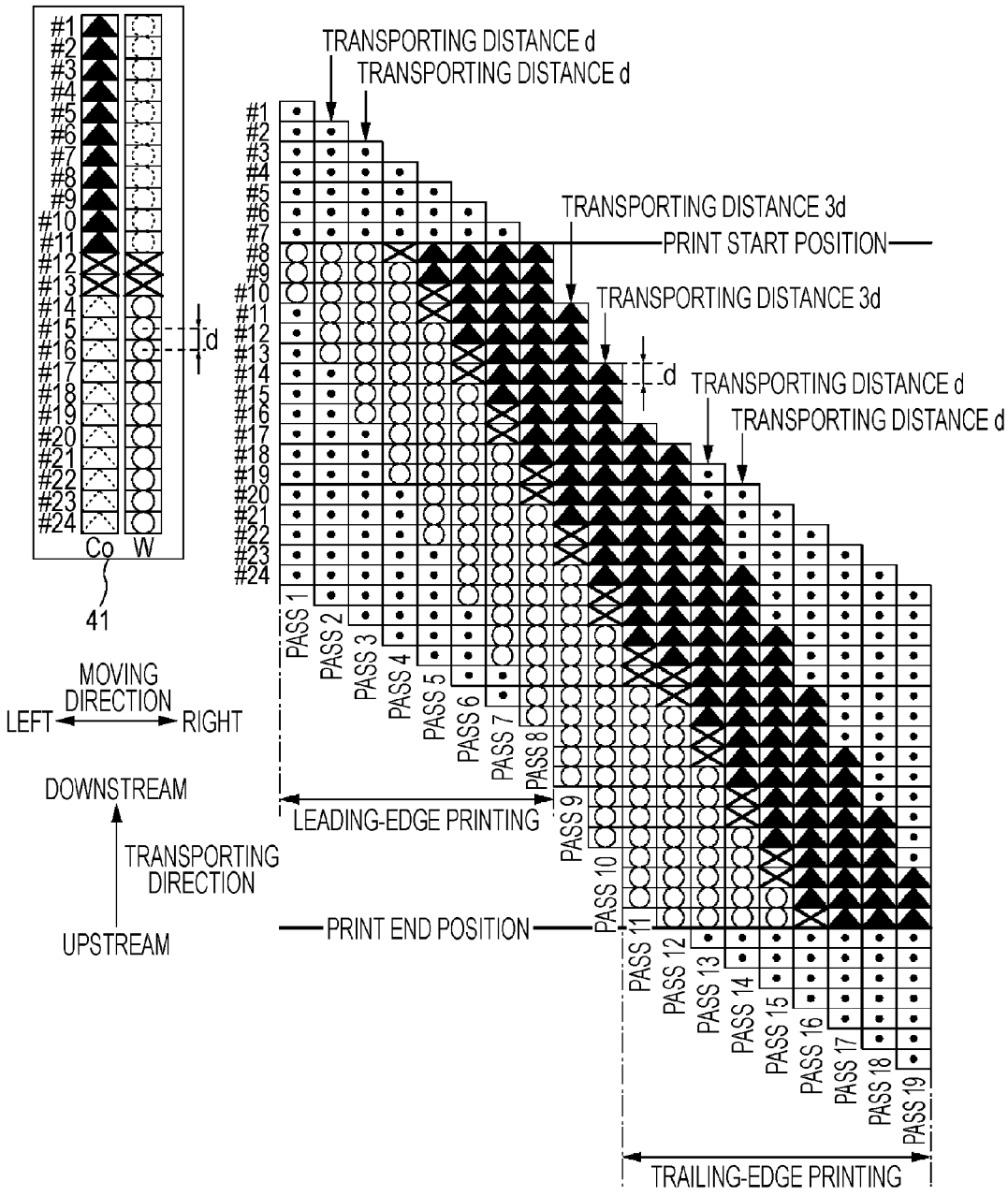
FIG. 9 illustrates a printing method of a comparative example with a different number of nozzles for drying.

FIG. 9 illustrates a printing method of a comparative example with a different number of drying nozzles. FIG. 9 corresponds to printing operation performed in the front-side print mode, and in normal printing, 11 background-image-forming nozzles (○) are used, 11 color-image-forming nozzles (▲) are used, and two drying nozzles (x) are used. Specifically, the printing method shown in FIG. 9 differs from the printing method according to this embodiment in that a length (2*d*), in the transporting direction, of a region to which the drying nozzles belong is a non-integral multiple (two-thirds) of the transporting distance (3*d*) of the medium S for normal printing.

The transporting distance 3*d* of the medium S for normal printing is three times the nozzle pitch d, and when performing normal printing, the medium S is shifted downstream relative to the nozzles (head 41) by a distance equivalent to three nozzles in each pass. Therefore, if the number of drying nozzles is set to a value corresponding to a non-integral multiple of the transporting distance 3*d* of the medium S, for example, when the drying nozzles (x) are shifted upstream by three nozzles from pass 9 to pass 10 in normal printing in FIG. 9, there is a certain region of the medium S that cannot face the drying nozzles. As a result, the image printed as the result of normal printing has a region corresponding to where the drying passes are provided and a region where corresponding to the drying passes are not provided, resulting in the occurrence of uneven density in the image.

The transporting distance d of the medium S for leading-edge printing and trailing-edge printing are set shorter than the transporting distance 3*d* of the medium S for normal printing. However, in leading-edge printing and trailing-edge printing, the printing operation is commenced and completed for every region (equivalent to three cells) with three raster lines formed on the medium S, as in normal printing. Therefore, as shown in FIG. 9, when performing leading-edge printing and trailing-edge printing, the drying nozzles (x) are shifted upstream by three nozzles (three cells) relative to the medium S for each pass. As a result, the medium S disadvantageously has a region that faces the drying nozzles and a region that cannot face the drying nozzles.

Specifically, if the length (2*d* in FIG. 9), in the transporting direction, of the region to which the drying nozzles belong is set as a non-integral multiple of the transporting distance 3*d* of the medium S for normal printing similarly in leading-edge printing and trailing-edge printing, as in normal printing, variations in the drying period for the background image occur, resulting in the occurrence of uneven density in the image. Although FIG. 9 is directed to an example where the length 2*d*, in the transporting direction, of the region to which the drying nozzles belong is smaller than the transporting distance 3*d* of the medium S for normal printing, the example is not limited to such a configuration. For example, if the number of drying nozzles is four and the length (e.g., 4*d*), in the transporting direction, of the region to which the drying nozzles belong is greater than the transporting distance 3*d* of the medium S but is a non-integral multiple (four-thirds) thereof, variations in the drying period can occur. In that case, although the entire region of the medium S can face the drying nozzles, the number of drying nozzles that face the medium S varies depending on the location of the medium S. In light of this, for leading-edge printing and trailing-edge printing performed in the printing method according to the above-described embodiment (FIGS. 6 and 7), the length, in the transporting direction, of the region to which the drying nozzles belong is set as an integral multiple of the transporting distance 3*d* of the medium S for normal printing.

Furthermore, for leading-edge printing, trailing-edge printing, and normal printing in the printing method of this comparative example, the length, in the transporting direction, of the region to which the nozzles for printing each image belong is also set as a non-integral multiple of the transporting distance 3*d* of the medium S for normal printing.

For this reason, depending on the raster lines, some dots are formed in four passes (four nozzles), while some dots are formed in three passes (three nozzles). This complicates the control of the printing operation. Therefore, the length, in the transporting direction, of the region to which the nozzles for printing each image belong is also preferably set as an integral multiple of the transporting distance 3*d* of the medium S for normal printing, as in the printing method according to the above-described embodiment.

Although the above description is directed to the front-side print mode as an example, the mode is not limited. Even when performing under the reverse-side print mode for first printing the color image on the medium S and subsequently printing the background image over the color image, drying passes may be provided between the printing of the two images. In the reverse-side print mode, the nozzles may be inverted from those in the front-side print mode, such that the color-image-forming nozzles (▲) in FIGS. 6 and 7 may be changed to the background-image-forming nozzles (○), and the background-image-forming nozzles (○) in FIGS. 6 and 7 may be changed to the color-image-forming nozzles (▲). However, the position of the drying nozzles (x) is the same between the front-side print mode and the reverse-side print mode.

Modifications

Figure 10:
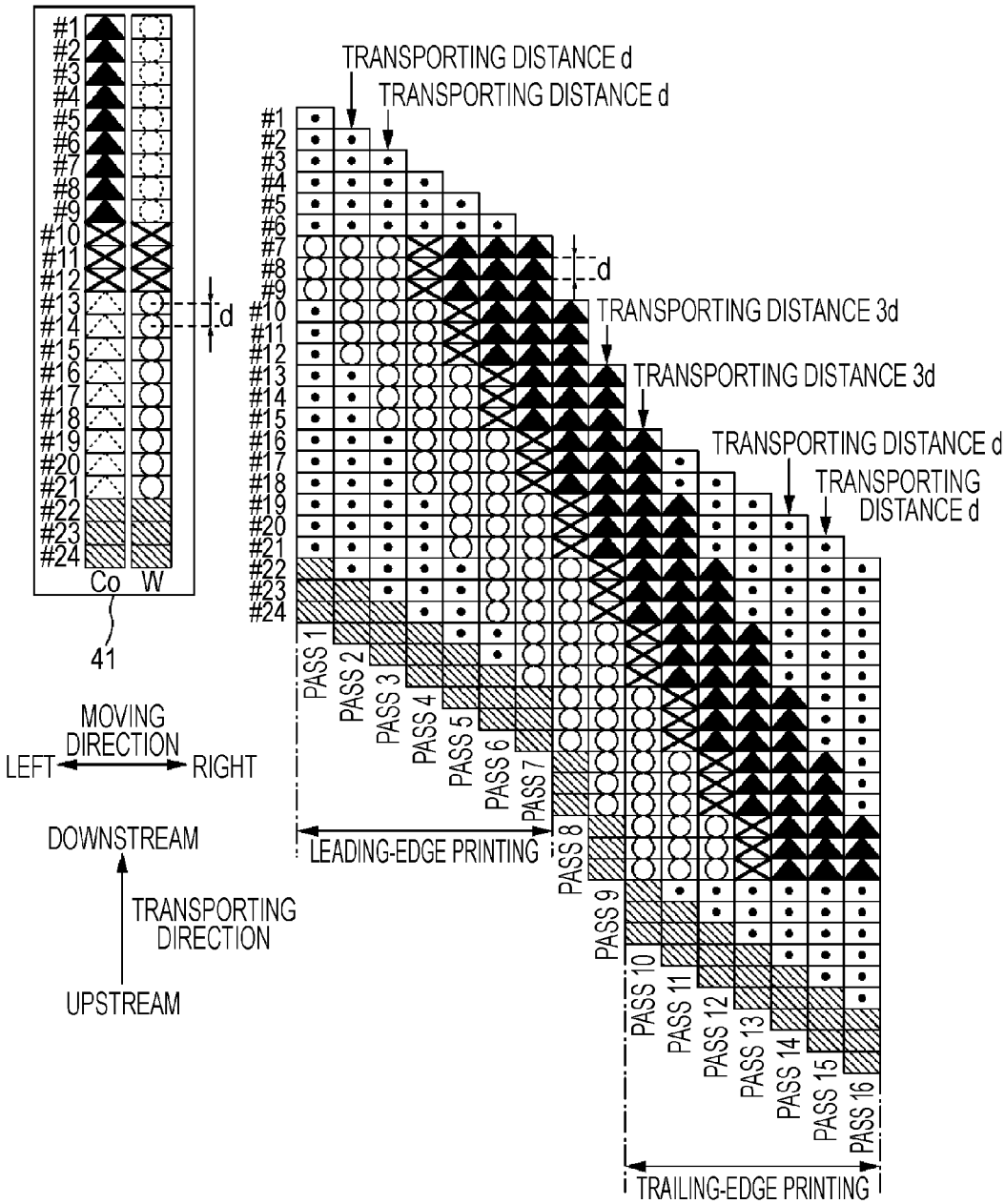
FIG. 10 illustrates a printing method with a different number of nozzles for drying.

FIG. 10 illustrates a printing method performed in the front-side print mode with a different number of drying nozzles. Although the length 6*d*, in the transporting direction, of the region to which the drying nozzles belong is twice as long the transporting distance 3*d* of the medium S for normal printing in the above-described embodiment (FIGS. 6 and 7), the invention is not limited to this configuration. The number of drying nozzles may be changed in accordance with the dryability of the first image (i.e., the background image in FIG. 10) to be printed. If the first image to be printed has good dryability, the number of drying nozzles may be reduced. For example, three drying nozzles corresponding to a single multiple of the transporting distance 3*d* of the medium S for normal printing may be used, as in the printing method shown in FIG. 10. In this case, over the entire image region, a single drying pass is performed between the printing of the background image and the printing of the color image, so that uneven density in the image can be prevented. On the other hand, if the first image to be printed has poor dryability, the number of drying nozzles may be increased.

In addition to the drying nozzles, the length, in the transporting direction, of the region to which the nozzles for printing each image belong may be an integral multiple of the transporting distance 3*d* of the medium S for normal printing. In FIG. 10, each nozzle array has 24 nozzles, three of which are drying nozzles. Therefore, nine nozzles may be used for printing each image, and the remaining three nozzles (shaded sections in FIG. 10) may be inactive nozzles. Consequently, the number of passes for forming each image can be kept constant at three times (i.e., three nozzles) over the entire image region.

Figure 11:
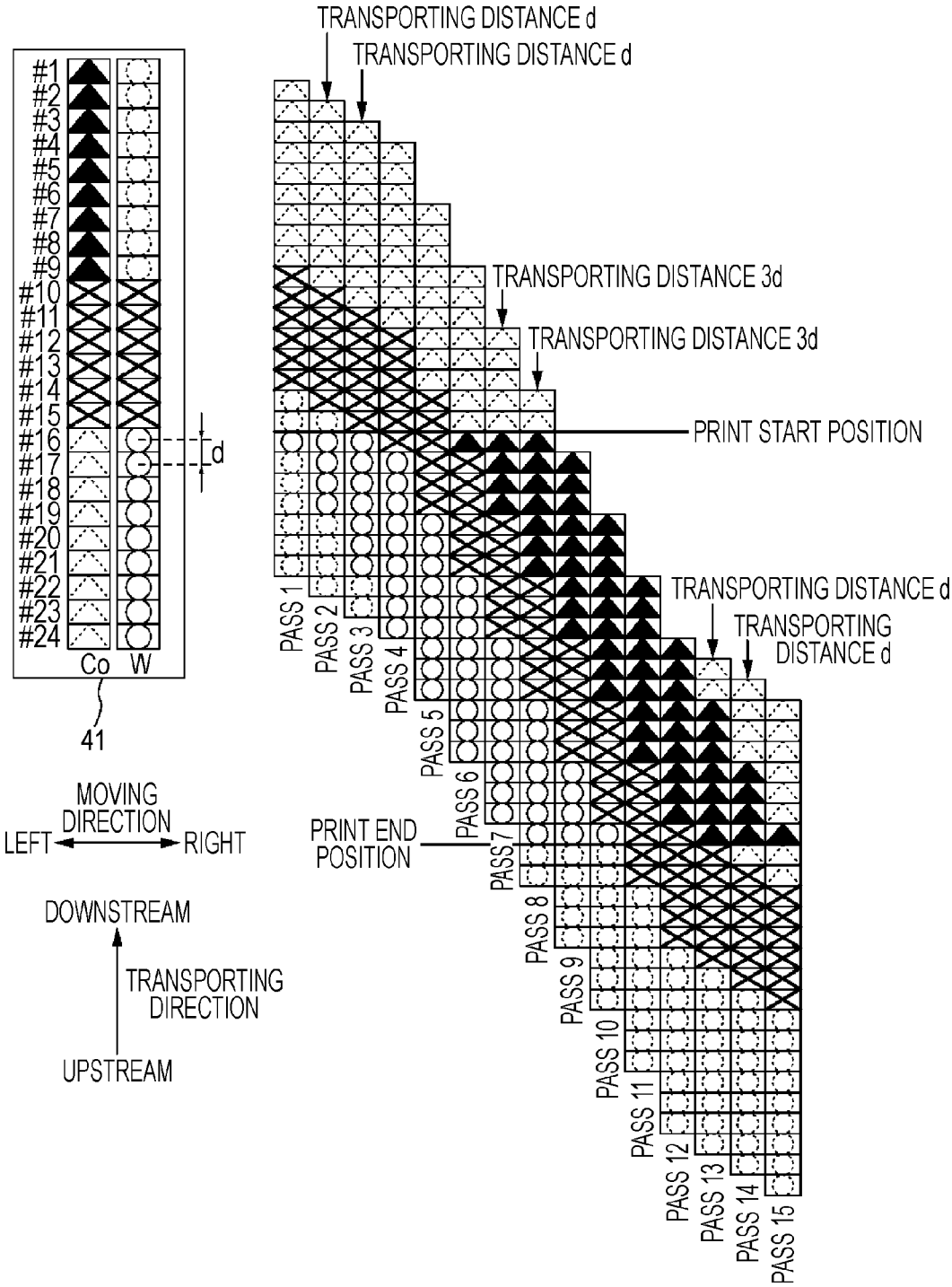
FIG. 11 illustrates a printing method in which the nozzles used in leading-edge printing and trailing-edge printing are the same as the nozzles used in normal printing.

FIG. 11 illustrates a printing method in which the nozzles used in leading-edge printing and trailing-edge printing are the same as the nozzles used in normal printing. In the above-described embodiment (FIGS. 6 and 7), in order to shorten the positional control range for the medium S (e.g., in order to reduce the amount of margin of the medium S), leading-edge printing is performed by using nozzles located downstream of the background-image-forming nozzles (○) and the drying nozzles (x) used in normal printing, and trailing-edge printing is performed by using nozzles located upstream of the color-image-forming nozzles (▲) and the drying nozzles (x) used in normal printing. However, the invention is not limited to this configuration. As shown in FIG. 11, when performing leading-edge printing and trailing-edge printing, the position of the color-image-forming nozzles (#1 to #9), the position of the drying nozzles (#10 to #15), and the position of the background-image-forming nozzles (#16 to #24) may be fixed, as in normal printing.

Even in this case, in leading-edge printing, trailing-edge printing, and normal printing, the length, in the transporting direction, of the region to which the drying nozzles belong is set as an integral multiple of the transporting distance 3*d* of the medium S for normal printing, so that the number of drying passes for the entire image region can be kept constant, thereby preventing uneven density in the image. However, as compared with the printing method of the comparative example in FIG. 5 where there are no drying nozzles, the print start position is located further upstream and the print end position is located further downstream by a distance equivalent to the drying nozzles in FIG. 11. Therefore, as in the above-described printing method (FIGS. 6 and 7), when the drying nozzles are provided, it is particularly effective to make the nozzles variable in leading-edge printing and trailing-edge printing, so that the positional control range of the medium S can be advantageously reduced (that is, the amount of margin thereof can be advantageously reduced).

Other Embodiments

Although the above-described embodiment is mainly directed to a printing system including an ink jet printer, the above-described embodiment also includes the disclosure of a method of correcting uneven density. Furthermore, the above-described embodiment is intended for ease of understanding of the invention but not for limiting the invention. It should be noted that the invention permits modifications and alterations so long as they are within the scope of the invention, and that equivalents thereof are included in the invention. In particular, the invention may include the following embodiments.

Drying Nozzles in Normal Printing

In the above-described embodiment, although the length, in the transporting direction, of the region to which the drying nozzles in normal printing belong is set as an integral multiple of the transporting distance of the medium S for normal printing, the invention is not limited to this configuration. The length, in the transporting direction, of a region to which drying nozzles in at least one of leading-edge printing and trailing-edge printing belong may be set as an integral multiple of the transporting distance of the medium S for normal printing so that the drying period for the image formed as the result of the printing operation can be kept constant. Moreover, in the above-described embodiment, although the lengths, in the transporting direction, of the regions to which the nozzles for forming the background image and the color image belong are each set as an integral multiple of the transporting distance of the medium S for normal printing, the invention is not limited to this configuration.

Printing of Multiple Images

Although the above-described embodiment is directed to an example where printing operation is performed for two images, the invention is not limited to this example. In the case where three or more images are to be printed one on top of the other, the nozzles for a first image to be printed may be nozzles located upstream of the nozzles for a subsequent image to be printed, and drying nozzles may be provided between these nozzles. Furthermore, depending on the dryability of the image, the drying nozzles may be provided between the aforementioned nozzles, or the number of drying nozzles may be changed.

Background Image

Although the background image is printed using white ink in the above-described embodiment, the background image may alternatively be printed using color ink (such as metallic-based ink) other than white ink. Moreover, instead of using only white ink to print the background image, a mixture of white ink and other color ink may be used to print a tint-adjusted white background image. As a further alternative, the four color inks (YMCK) may be added to white ink so as to print a color image.

Other Printers

Although the above-described embodiment is directed to a type of a printer that repeatedly performs the operation for forming an image while moving the head 41 in the moving direction and the operation for transporting the medium S in the transporting direction as an example, the invention is not limited to such a printer. For example, the printer may be of a type that forms an image on a continuous sheet transported to a printing region by alternately repeating operation for forming an image while moving the head 41 in the transporting direction of the continuous sheet and operation for moving the head 41 in a sheet-width direction orthogonal to the transporting direction, and subsequently transporting a non-printed section of the continuous sheet to the printing region.

Nozzle Arrays

Although four nozzle arrays that respectively eject the four color inks (YMCK) are arranged in the moving direction in the above-described embodiment, as shown in FIG. 3, the invention is not limited to this configuration. For example, of the four color nozzle arrays, two color nozzle arrays may be arranged in the transporting direction, such that two groups of the color nozzle arrays arranged in the transporting direction are arranged side-by-side in the moving direction. In this case, the length of the white nozzle array W is equal to the length of two color nozzle arrays. Similar to the above, in order to perform the front-side print mode in such a printer, for example, the upstream-side nozzle array of the two color nozzle arrays arranged in the transporting direction may use half of the nozzles at the downstream side in the transporting direction, the downstream-side nozzle array may use half of the nozzles at the upstream side, and the white nozzle array W may use one-fourth of the nozzles at the upstream-most side. Even in this case, for leading-edge printing and trailing-edge printing, the number of drying nozzles provided between the ejection nozzles of the white nozzle array W and the ejection nozzles of each of the four color nozzle arrays may be set as an integral multiple of the transporting distance of the medium S for normal printing.

Printing Method

Although the above-described embodiment is directed to an overlap printing method as an example, the invention is not limited to this method. Other printing methods (such as a printing method for forming multiple raster lines in different passes between raster lines arranged at the nozzle pitch d, as in interlace printing) are also permissible.

Fluid Ejecting Apparatus

Although an ink jet printer is described as an example of a fluid ejecting apparatus in the above-described embodiment, the invention is not limited to an ink jet printer. The fluid ejecting apparatus need not to be a printer but may be various industrial apparatuses. For example, the invention is applicable to a textile printing apparatus for printing patterns on fabric, a color-filter manufacturing apparatus, a display manufacturing apparatus, such as an organic EL display manufacturing apparatus, or a DNA-chip manufacturing apparatus for manufacturing DNA chips by applying a DNA-containing solution to chips.

Furthermore, the fluid ejecting method may be a piezo method in which a fluid is ejected by applying voltage to a drive element (piezo element) to expand and contract an ink chamber, or a thermal method in which a liquid is ejected by forming bubbles in nozzles using a heat-generating element. Furthermore, the ink to be ejected from the head 41 may be ultraviolet curable ink that cures when ultraviolet light is emitted thereto, or fine particles may be ejected from the head 41.

The entire disclosure of Japanese Patent Application No. 2009-187832, filed Aug. 13, 2009, 2009-188944, filed Aug. 18, 2009 and 2009-276714, filed Dec. 4, 2009 are expressly incorporated by reference herein.

What is claimed is:

1. A fluid ejecting apparatus comprising:

a plurality of nozzles comprising a first nozzle that ejects a first fluid and a second nozzle that ejects a second fluid; and a control section that performs:

an image forming operation for ejecting the fluids from the first nozzle and the second nozzle while relatively moving the first nozzle, the second nozzle, and a medium in the moving direction, and a shifting operation for relatively shifting a relative position between the first nozzle, the second nozzle, and the medium towards one side in a predetermined direction, wherein when forming a second image using the second fluid over a first image formed using the first fluid, the second nozzle used for forming the second image is located towards the one side in the predetermined direction relative to the first nozzle used for forming the first image, and wherein the fluid is not ejected from a non-ejection nozzle included in the plurality of nozzles that is located towards the one side in the predetermined direction relative to the first nozzle used for forming the first image and is located towards the other side in the predetermined direction relative to the second nozzle used for forming the second image, and wherein a length, in the predetermined direction, of a region containing the non-ejection nozzle is an integral multiple of the predetermined transporting distance.

2. The fluid ejecting apparatus according to claim 1, wherein the first nozzle comprises a plurality of first nozzles, wherein when performing a first image forming operation on the medium the first nozzle used for forming the first image is located towards the one side in the predetermined direction relative to the first nozzle used for forming the first image during at least one image forming operation other than the first image forming operation.

3. The fluid ejecting apparatus according to claim 1, wherein the second nozzle comprises a plurality of second nozzles, wherein when performing a last image forming operation on the medium the second nozzle used for forming the second image is located towards the other side in the predetermined direction relative to the second nozzle used for forming the second image during at least one image forming operation other than the last image forming operation.

4. The fluid ejecting apparatus according to claim 1, wherein a length, in the predetermined direction, of a region containing at least one of the first nozzle used for forming the first image and the second nozzle used for forming the second image is an integral multiple of the predetermined transporting distance.

5. A fluid ejecting method performed by a fluid ejecting apparatus including a plurality of nozzles comprising a first nozzle that ejects a first fluid, and a second nozzle that ejects a second fluid, the fluid ejecting apparatus being configured to perform an image forming operation for ejecting the fluids from the first nozzle and the second nozzle while relatively moving the first nozzle, the second nozzle, and a medium in the moving direction; and a shifting operation for relatively shifting a relative position between the first nozzle, the second nozzle, and the medium towards one side in a predetermined direction, the fluid ejecting method comprising:

forming a second image using the second fluid over a first image formed using the first fluid, wherein when forming the second image, the second nozzle used for forming the second image is located towards the one side in the predetermined direction relative to the first nozzle used for forming the first image, and wherein the fluid is not ejected from a non-ejection nozzle, of the plurality of nozzles, that is located towards the one side in the predetermined direction relative to the first nozzle used for forming the first image and is located towards the other side in the predetermined direction relative to the second nozzle used form forming the second image, and wherein a length, in the predetermined direction, of a region containing the non-ejection nozzle is an integral multiple of the predetermined transporting distance.

* * * * *